US011725434B2

(12) United States Patent
Williams

(10) Patent No.: US 11,725,434 B2
(45) Date of Patent: Aug. 15, 2023

(54) POWER TAILGATE DETECTION SYSTEMS FOR DETECTING OBJECTS IN A MOVING PATH OF A POWERED TAILGATE

(71) Applicant: Toyota Motor Engineering & Manufacturing North America, Inc., Plano, TX (US)

(72) Inventor: Paxton S. Williams, Milan, MI (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 457 days.

(21) Appl. No.: 16/996,511

(22) Filed: Aug. 18, 2020

(65) Prior Publication Data

US 2022/0056741 A1 Feb. 24, 2022

(51) Int. Cl.

| | |
|---|---|
| ***E05F 15/43*** | (2015.01) |
| ***E05C 17/00*** | (2006.01) |
| ***E05F 15/41*** | (2015.01) |

(52) U.S. Cl.

CPC ..... *E05C 17/006* (2013.01); *E05F 15/41* (2015.01); *E05F 15/43* (2015.01); *E05F 2015/435* (2015.01); *E05Y 2900/546* (2013.01)

(58) Field of Classification Search

CPC . E05F 15/40; E05F 15/41; E05F 15/43; E05F 15/73; E05F 2015/435; E05F 2015/436; E05Y 2900/546; E05Y 2900/544; E05C 17/006

See application file for complete search history.

(56) References Cited

U.S. PATENT DOCUMENTS

| | | | | |
|---|---|---|---|---|
| 5,982,126 | A * | 11/1999 | Hellinga | B60J 5/06 318/434 |
| 6,676,186 | B2 * | 1/2004 | Greif | E05F 15/43 49/27 |
| 7,236,088 | B2 | 6/2007 | Matsukawa et al. | |
| 8,882,174 | B2 * | 11/2014 | Wechs | E05F 15/43 296/146.8 |
| 8,938,337 | B2 * | 1/2015 | Nakakura | G01S 17/42 701/1 |
| 9,476,243 | B2 | 10/2016 | Wuerstlein et al. | |
| 9,487,160 | B2 * | 11/2016 | Buschmann | H04N 23/00 |
| 9,689,982 | B2 * | 6/2017 | Herthan | G01S 13/0209 |

(Continued)

FOREIGN PATENT DOCUMENTS

| | | | |
|---|---|---|---|
| CN | 108868425 | A | 11/2018 |
| DE | 102006051400 | A1 | 2/2008 |

(Continued)

*Primary Examiner* — Justin B Rephann
(74) *Attorney, Agent, or Firm* — Dinsmore & Shohl LLP

(57) ABSTRACT

A power tailgate detection system is provided including a vehicle, a sensing system, and a control unit. The vehicle includes a bumper and a tailgate moveable between a closed position and an open position. The sensing system is disposed on an exterior surface of the tailgate and includes at least one emitter and at least one receiver. The emitter is positioned to emit radiation in a direction parallel to the exterior surface of the tailgate. The receiver is positioned to receive the radiation emitted by the emitter. The control unit is configured to control operation of the tailgate between to prohibit movement of the tailgate toward the open position when an object interferes with the radiation.

17 Claims, 3 Drawing Sheets

(56) References Cited

U.S. PATENT DOCUMENTS

| | | | | |
|---|---|---|---|---|
| 9,725,942 | B2 * | 8/2017 | Gunreben | E05F 15/40 |
| 9,777,518 | B2 | 10/2017 | Warschat et al. | |
| 10,914,110 | B2 * | 2/2021 | Mitchell | G01S 13/931 |
| 10,961,768 | B2 * | 3/2021 | Rrumbullaku | E05F 15/40 |
| 11,480,006 | B2 * | 10/2022 | Tokudome | B60J 5/00 |
| 2001/0042989 | A1 * | 11/2001 | Greif | E05F 15/40 296/50 |
| 2002/0084675 | A1 * | 7/2002 | Buchanan, Jr. | B60J 5/101 296/146.8 |
| 2005/0237168 | A1 * | 10/2005 | Matsukawa | B60Q 1/447 340/932.2 |
| 2009/0242310 | A1 * | 10/2009 | Touge | G01S 15/876 180/289 |
| 2009/0243826 | A1 * | 10/2009 | Touge | B60Q 9/00 340/436 |
| 2014/0085467 | A1 * | 3/2014 | Barthel | B60R 11/04 348/148 |
| 2015/0009062 | A1 * | 1/2015 | Herthan | G01S 7/415 342/70 |
| 2015/0345205 | A1 * | 12/2015 | Gunreben | E05F 15/40 701/2 |
| 2016/0024825 | A1 * | 1/2016 | Warschat | B60J 5/101 701/49 |
| 2016/0176346 | A1 * | 6/2016 | Kiehl | B62D 33/027 49/31 |
| 2018/0238099 | A1 * | 8/2018 | Schatz | E05F 15/622 |
| 2019/0128040 | A1 * | 5/2019 | Mitchell | E05F 15/40 |
| 2019/0292838 | A1 * | 9/2019 | Tokudome | E05F 15/40 |
| 2019/0376333 | A1 * | 12/2019 | Rrumbullaku | E05F 15/46 |

FOREIGN PATENT DOCUMENTS

| | | | |
|---|---|---|---|
| DE | 102011082547 | A1 | 3/2013 |
| KR | 20200043113 | A | 4/2020 |

* cited by examiner

POWER TAILGATE DETECTION SYSTEMS FOR DETECTING OBJECTS IN A MOVING PATH OF A POWERED TAILGATE

TECHNICAL FIELD

The present specification generally relates to vehicle tailgate systems for controlling movement of a powered tailgate and, more specifically, prohibiting movement of a tailgate from a closed position to an open position when an object is detected within a moving path of the tailgate to prevent damage to the tailgate.

BACKGROUND

Strain gauges and pinch sensors are used on weather strips of vehicle tailgates to detect if an object is blocking the vehicle's tailgate from closing. However, these strain gauges and pinch sensors cannot detect if an object is positioned within a moving path of a powered tailgate that would prevent the tailgate from opening properly. Torque sensors may be provided within a motor of the tailgate to detect an increase in strain or energy indicating that the tailgate is contacting an object while moving from a closed position to an open position. If increased strain is detected, the motor may be instructed to cease opening the tailgate or return the tailgate to the closed position. However, such torque sensors do not detect the presence of an object prior to the tailgate contacting the object. Thus, an object in a moving path of the tailgate may still cause damage to the tailgate, such as the exterior surface thereof, prior to movement of the tailgate being ceased.

SUMMARY

In one embodiment, a power tailgate detection system includes a vehicle including a bumper and a tailgate moveable between a closed position and an open position relative to the bumper. A sensing system is disposed on an exterior surface of the tailgate. The sensing system includes at least one emitter positioned to emit radiation in a direction parallel to the exterior surface of the tailgate, and at least one receiver positioned to receive the radiation emitted by the at least one emitter. A control unit is configured to control operation of the tailgate between the closed position and the open position and prohibit movement of the tailgate toward the open position when an object interferes with the radiation and the control unit determines that the tailgate will contact the object upon continued movement of the tailgate toward the open position.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are directed to power tailgate detection systems that include sensing systems for detecting an object in a moving pathway of a power tailgate as the tailgate moves from a closed position to an open position.

The power tailgate detection systems described herein include a power tailgate moveable between a closed position and an open position relative to a vehicle bumper. A sensing system is disposed on the exterior surface of the tailgate and includes at least one emitter positioned to emit radiation in a direction parallel to the exterior surface of the tailgate, and at least one receiver positioned to receive the radiation emitted by the at least one emitter. A control unit is configured to control operation of the tailgate from the closed position toward the open position when an object interferes with the radiation to prevent damage to the exterior surface of the tailgate.

Figure 1:
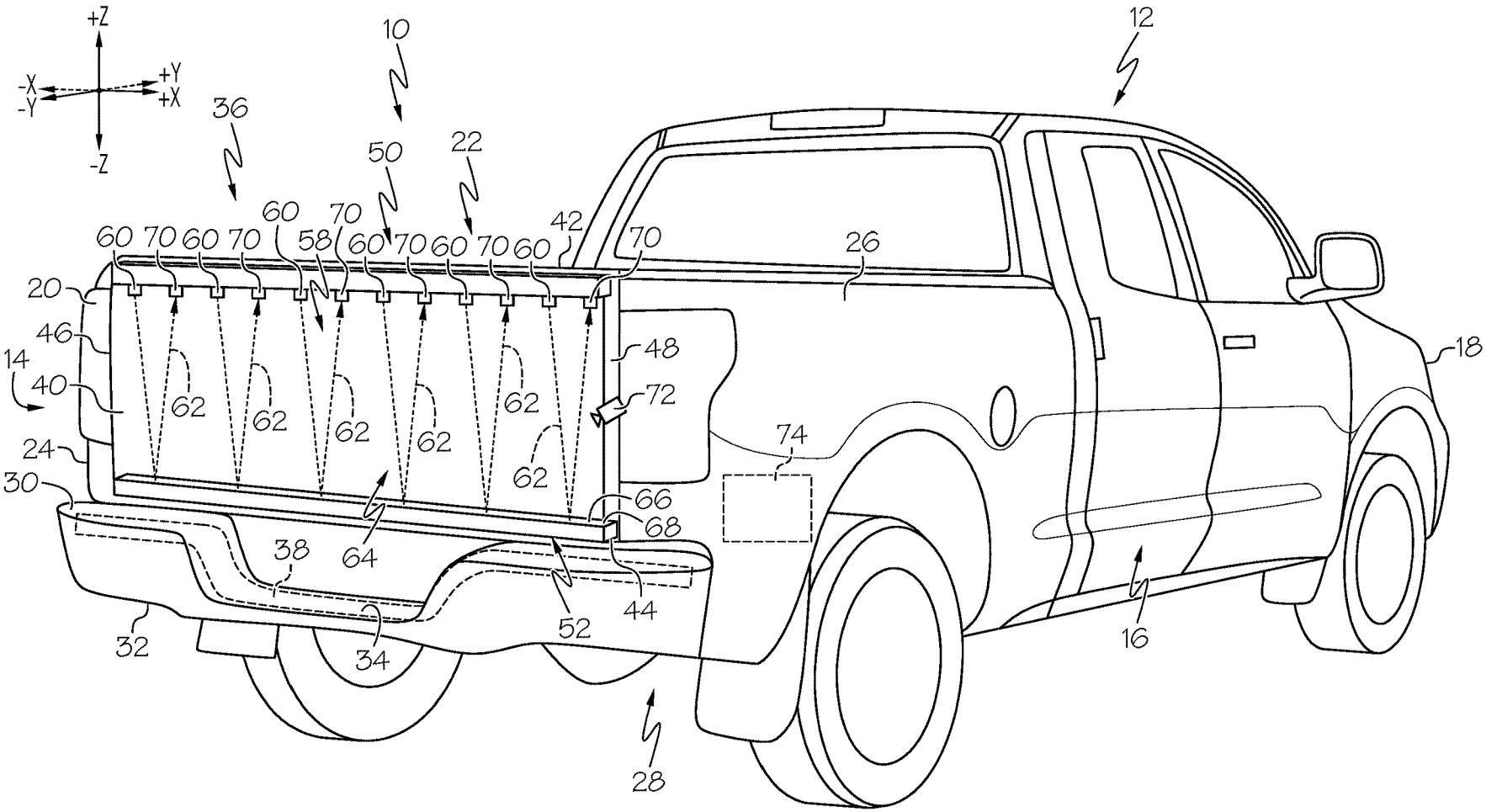
FIG. 1 schematically depicts a perspective view of an embodiment of a vehicle including a sensing system provided on an exterior surface of a tailgate according to one or more embodiments shown and described herein.

As used herein, the term "vehicle longitudinal direction" refers to the forward-rearward direction of the vehicle (i.e., in the +/−Y direction of the coordinate axes depicted in FIG. 1). The term "vehicle lateral direction" refers to the cross-vehicle direction (i.e., in the +/−X direction of the coordinate axes depicted in FIG. 1), and is transverse to the vehicle longitudinal direction. The term "vehicle vertical direction" refers to the upward-downward direction of the vehicle (i.e., in the +/−Z direction of the coordinate axes depicted in FIG. 1). As used herein, "upper" and "above" are defined as the positive Z direction of the coordinate axes shown in the drawings. "Lower" and "below" are defined as the negative Z direction of the coordinate axes shown in the drawings. Further, the terms "outboard" or "outward" as used herein refers to the relative location of a component with respect to a vehicle centerline. The term "inboard" or "inward" as used herein refers to the relative location of a component with respect to the vehicle centerline. Because the vehicle structures may be generally symmetrical about the vehicle centerline, the direction to which use of terms "inboard," "inward," "outboard" and "outward" refer may be mirrored about the vehicle centerline when evaluating components positioned along opposite sides of the vehicle.

Various embodiments of the power tailgate detection systems and the operation of the power tailgate detection systems are described in more detail herein. Whenever possible, the same reference numerals will be used throughout the drawings to refer to the same or like parts.

Referring now to FIG. 1, a power tailgate detection system 10 is illustrated according to one or more embodiments described herein. The power tailgate detection system 10 may generally include a vehicle 12 and a sensing system 14. The vehicle 12 includes a vehicle body 16 having a front end 18 and an opposite rear end 20. The vehicle body 16 has a truck bed 22 provided at the rear end 20 of the vehicle body 16 and defined in a vehicle lateral direction by a first side wall 24 and an opposite second side wall 26. The vehicle 12 includes a bumper 28 provided at the rear end 20 of the vehicle 12 having an upper surface 30 and an opposite bottom surface 32. A step 34 may be formed in the upper surface 30 of the bumper 28 and extends toward the bottom surface 32. The vehicle 12 also includes a tailgate 36 provided at the rear end 20 of the vehicle body 16. The tailgate 36 is pivotally attached to the rear end 20 of the vehicle body 16, each either proximate a lower end of the vehicle body 16 proximate the bumper 28 or proximate at least one of the first side wall 24 and the second side wall 26, and operable between a closed (e.g., substantially upright or vertical) position, as shown in FIG. 1, and an open (e.g., substantially horizontal) position.

It should be appreciated that, although the vehicle 12 is depicted herein as a pickup truck including the tailgate 36, the present disclosure is not limited to such a vehicle. As such, the present disclosure may be utilized with any other suitable vehicle in which the tailgate 36 is a pivotable rear door that operates between a closed position and an open position.

In some embodiments, the bumper 28 includes a load sensor 38 for detecting a load provided on the upper surface 30 of the bumper 28. As shown in FIG. 1, the load sensor 38 has an elongated shape and extends along the bumper 28 proximate the upper surface 30 thereof in the vehicle lateral direction. In some embodiments, the load sensor 38 may have a geometry corresponding to that of the upper surface 30 of the bumper 28 such that the load sensor 38 is provided within the step 34 or disposed on the step 34. In some embodiments, the load sensor 38 comprises a plurality of individual load sensor segments spaced apart from one another along the upper surface 30 of the bumper 28. In some embodiments, the load sensor 38, or individual load sensor segments, may be provided on top of the upper surface 30 of the bumper 28 as opposed to within the bumper 28 itself. As described in more detail herein, the load sensor 38 detects when a load is applied to the upper surface 30 of the bumper 28 and the tailgate 36 is prevented from moving from the closed position toward the open position when the detected load exceeds a predetermined threshold.

As shown in FIG. 1, the tailgate 36 of the vehicle 12 includes an exterior surface 40 facing a rearward direction away from the vehicle body 16 when the tailgate 36 is in the closed position. The tailgate 36 has an upper edge 42, an opposite lower edge 44, a first side edge 46, and an opposite second side edge 48. The first side edge 46 and the second side edge 48 of the tailgate 36 extend generally in the vehicle vertical direction between the upper edge 42 and the lower edge 44 of the tailgate 36, which extend generally in the vehicle lateral direction. The tailgate 36 includes an actuating device or motor that is positioned to cause movement of the tailgate 36 such that the tailgate 36 is motorized to move between the closed position and the open position.

The sensing system 14 is provided on the exterior surface 40 the tailgate 36 and includes a photoelectric sensor 50 that includes at least one emitter 60 for emitting radiation 58 and at least one receiver 70 for receiving the emitted radiation 58. In some embodiments, the photoelectric sensor 50 may also include a reflector 52. For example, the reflector 52 may be positioned to reflect the radiation 58 emitted from the emitter 60 toward the receiver 70. As depicted in the embodiment of FIG. 1, both the at least one emitter 60 and the at least one receiver 70 of the photoelectric sensor 50 are positioned at (e.g., on) the exterior surface 40 of the tailgate 36 proximate the upper edge 42 of the tailgate 36, and the reflector 52 is positioned on the exterior surface 40 of the tailgate 36 proximate the lower edge 44 of the tailgate 36 opposite the photoelectric sensor 50. However, the present disclosure is not limited to such an embodiment. That is, the photoelectric sensor 50 and the reflector 52 may be positioned and aligned in any location on the tailgate 36 that allows for the functionality of the photoelectric sensor 50 as described herein. For example, in some embodiments, the photoelectric sensor 50 may be positioned at the lower edge 44 of the tailgate 36 and the reflector 52 may be positioned at the upper edge 42 of the tailgate 36. In other embodiments, as described herein, the photoelectric sensor 50 may be provided proximate one of the first side edge 46 and the second side edge 48 of the tailgate 36, and the reflector 52 may be provided on the other of the first side edge 46 and the second side edge 48 of the tailgate 36. In other embodiments, the photoelectric sensor 50 may be provided at a corner of the tailgate 36, and the reflector 52 may be provided in an opposite corner of the tailgate 36. In other embodiments, the emitter 60 and the receiver 70 may each be provided at different locations on the tailgate 36. For example, the emitter 60 may be provided at one of the upper edge 42 and the lower edge 44 of the tailgate, and the receiver 70 may be provided at the other of the upper edge 42 and the lower edge 44 of the tailgate, thereby eliminating the need for the reflector 52 as the radiation 58 may be emitted from the emitter 60 directly toward the receiver 70.

Figure 2:
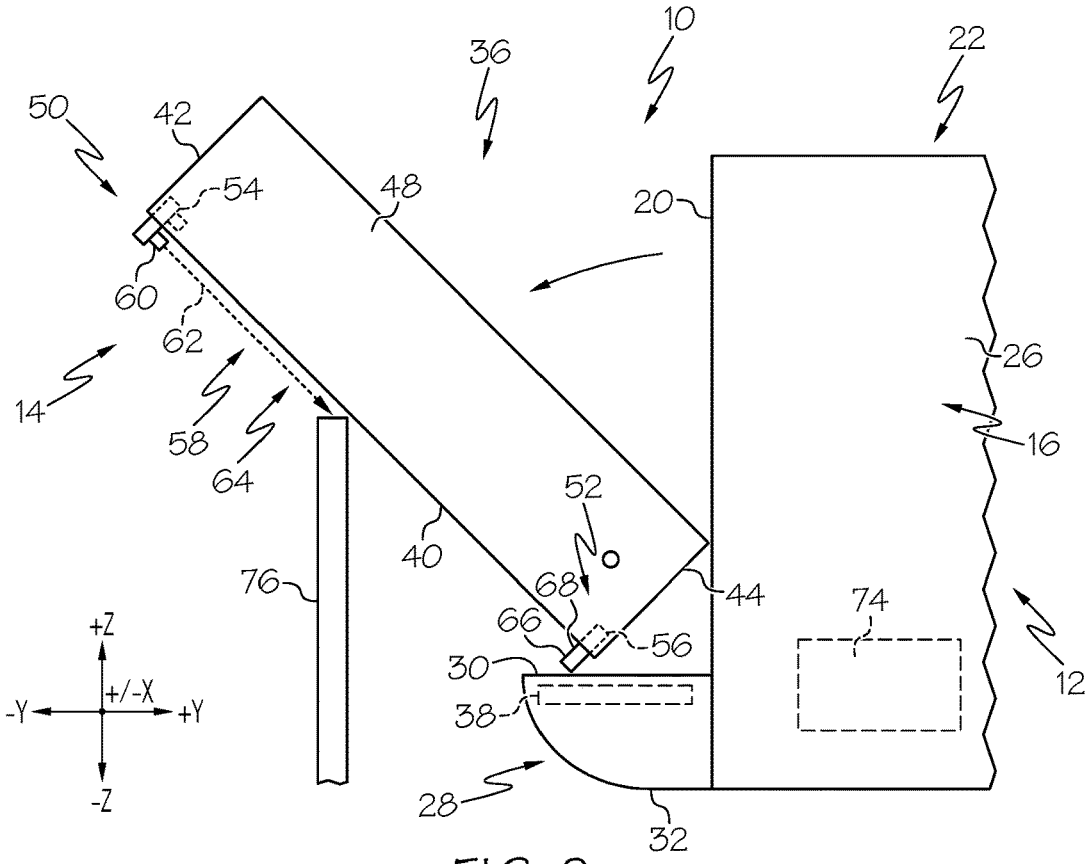
FIG. 2 schematically depicts a partial side view of the tailgate in an intermediate position according to one or more embodiments shown and described herein.
Figure 3:
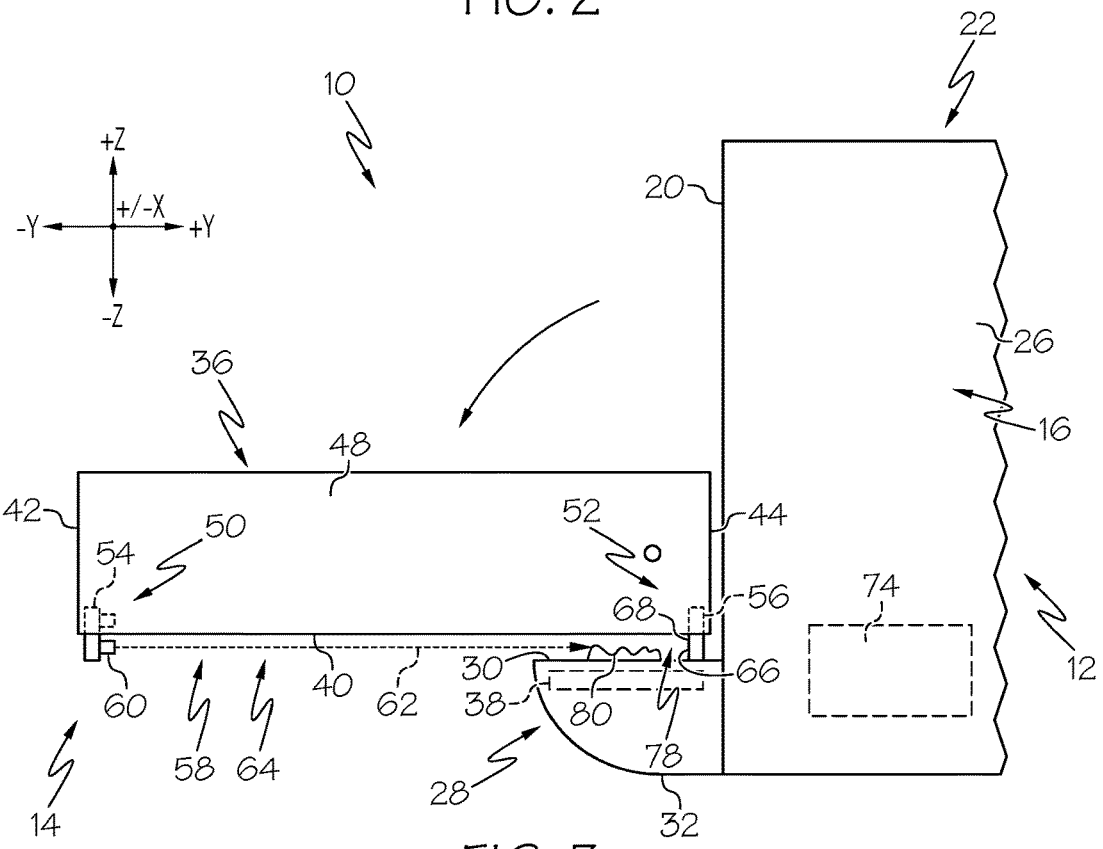
FIG. 3 schematically depicts a partial side view of the vehicle with the tailgate in an open position.

As previously noted, the photoelectric sensor 50 and the reflector 52 are positioned on the exterior surface 40 of the tailgate 36 in the embodiment of FIG. 1. However, the present disclosure is not limited to such. For example, as shown in FIGS. 2 and 3, the tailgate 36 includes a first recess 54 and a second recess 56 formed in the body of the tailgate 36 for receiving and stowing the photoelectric sensor 50 and/or the reflector 52, respectively, in a retracted position in some embodiments. That is, as shown by the dashed lines in FIGS. 2-3, the photoelectric sensor 50 and/or the reflector 52 may retract within the respective recesses 54, 56. Any suitable gears, motors, actuators, or the like may be provided within the first recess 54 and the second recess 56 for controlling movement of the photoelectric sensor 50 and the reflector 52 between the retracted position and an extended position in which the photoelectric sensor 50 and the reflector 52 extend out of the first recess 54 and the second recess 56.

Referring again to FIG. 1, the emitter 60 of the photoelectric sensor 50 is positioned to emit radiation 58 in a direction parallel to the exterior surface 40 of the tailgate 36. The emitter 60 may include any suitable device for emitting radiation. As used herein, radiation may refer to any wavelengths of light within the near infrared spectrum (e.g., wavelengths of light typically emitted by a near infrared laser). As such, the emitter 60 may include, for example, a semiconductor laser device, such as a LiDaR device, GaAs, or a GaA1As laser. Additionally, in some embodiments, the emitter 60 may be supplemented with radar, ultrasonic, or IR-based technology without departing from the scope of the present disclosure. The emitter 60 is configured to emit radiation 58 across at least a substantial portion of the exterior surface 40 of the tailgate 36 in the vehicle lateral direction. Thus, the emitter 60 may have an elongated shape for extending along the tailgate 36 proximate the upper edge 42 thereof. In some embodiments, the emitter 60 may be configured to emit a continuous radiation curtain across the exterior surface 40 of the tailgate 36 in the vehicle lateral direction.

As shown in FIG. 1, in some embodiments, each emitter 60 emits an individual radiation beam 62 toward the reflector 52 at the opposite lower edge 44 of the tailgate 36. The plurality of emitters 60 may be spaced apart from one another and oriented in the same direction such that the plurality of radiation beams 62 are emitted parallel to one another to form a radiation grid 64 as opposed to a continuous radiation curtain.

As noted above, the reflector 52 of the sensing system 14 is provided proximate the lower edge 44 of the tailgate 36, opposite the photoelectric sensor 50, and specifically the emitters 60, and configured to reflect the radiation 58 emitted from the emitters 60. The reflector 52 extends along at least a substantial portion of the lower edge 44 of the tailgate 36. The reflector 52 has an upper surface 66 facing the photoelectric sensor 50 and extending transverse to the exterior surface 40 of the tailgate 36.

As described in more detail herein, the reflector 52 is configured to reflect radiation 58 toward the receiver 70. As such, the upper surface 66 of the reflector 52 includes a reflective coating 68, such as a mirror or the like, for reflecting the radiation 58 toward the photoelectric sensor 50. In some embodiments, the reflective coating 68 may include at least one faceted surface for adjusting the direction in which the radiation 58 is reflected toward the receiver 70.

As noted above, the photoelectric sensor 50 include at least receiver 70 such as, for example, a photoelectric sensor or the like, for receiving the radiation 58 reflected by the reflector 52. In some embodiments, the photoelectric sensor 50 includes a plurality of receivers 70 that are spaced apart from one another and each positioned to receive a radiation beam 62 emitted by an associated emitter 60 and reflected by the reflector 52. As shown in FIG. 1, in some embodiments, the emitters 60 and the receivers 70 are arranged in an alternating pattern in the vehicle lateral direction along the photoelectric sensor 50. However, it should be appreciated that other arrangements are within the scope of the present disclosure such as, for example, the emitters 60 and the receivers 70 may be arranged in pairs, wherein each pair extends in the vehicle longitudinal direction when the tailgate 36 is in the closed position. In other embodiments, the emitters 60 and the receivers 70 may be a single detection device capable of both emitting and receiving/detecting radiation.

As shown in FIG. 1, the power tailgate detection system 10 may include an imaging device 72, such as a camera, infrared sensor, thermal camera, or the like, having a field of view extending across the exterior surface 40 of the tailgate 36 for capturing object image data of an object interfering with the radiation 58. In some embodiments, object image data captured by the imaging device 72 may include at least one identifying parameter of an object within a field of view of the imaging device 72. Identifying parameters may include, for example, color, shape, size, density, height, and the like of an object. Thus, as described in more detail herein, it may be determined that the object identified by the imaging device 72 and interfering with the radiation 58 may not cause significant damage to the exterior surface 40 of the tailgate 36 and, thus, operation of the tailgate 36 from the closed position to the open position is not prevented.

The power tailgate detection system 10 also includes a control unit 74 communicatively coupled to the tailgate 36, the load sensor 38, the sensing system 14, and/or the imaging device 72. Specifically, the control unit 74 is coupled to the tailgate 36, such as to the motor of the tailgate 36, for controlling movement of the tailgate 36 between the closed position and the open position in response to the control unit 74 receiving a tailgate operating request. The tailgate operating request may be sent to the control unit 74 from an onboard computer of the vehicle 12 through a wired or wireless connection and/or wirelessly from a user remote device such as, for example, a mobile computing device or a key fob. The control unit 74 further controls movement of the tailgate 36 from the closed position toward the open position in response to signals sent to the control unit 74 from the load sensor 38, the sensing system 14, and the imaging device 72. The control unit 74 includes a processor and a non-transitory, processor-readable memory. The processor may be any device capable of executing the machine-readable instruction set stored in the non-transitory, processor-readable memory. Accordingly, the processor may be an electric controller, an integrated circuit, a microchip, a computer, or any other computing device. The memory of the control unit 74 may include a database of database objects and tailgate operating instructions associated with each database object. The database may include specific tailgate operating instructions for each database object such as, for example, permitting opening of the tailgate 36 when the object is identified as a first object that a user may determine will not significantly damage the tailgate 36 upon contact such as, for example, a flower or snow, and prohibiting opening of the tailgate 36 when the object is identified as a second object that a user may determine may significantly damage the tailgate 36 upon contact such as, for example, ice or rocks. These tailgate operating instructions may be preset or modifiable by a user such that a user may select what objects would cause the tailgate 36 to be prevented from opening.

Figure 4:
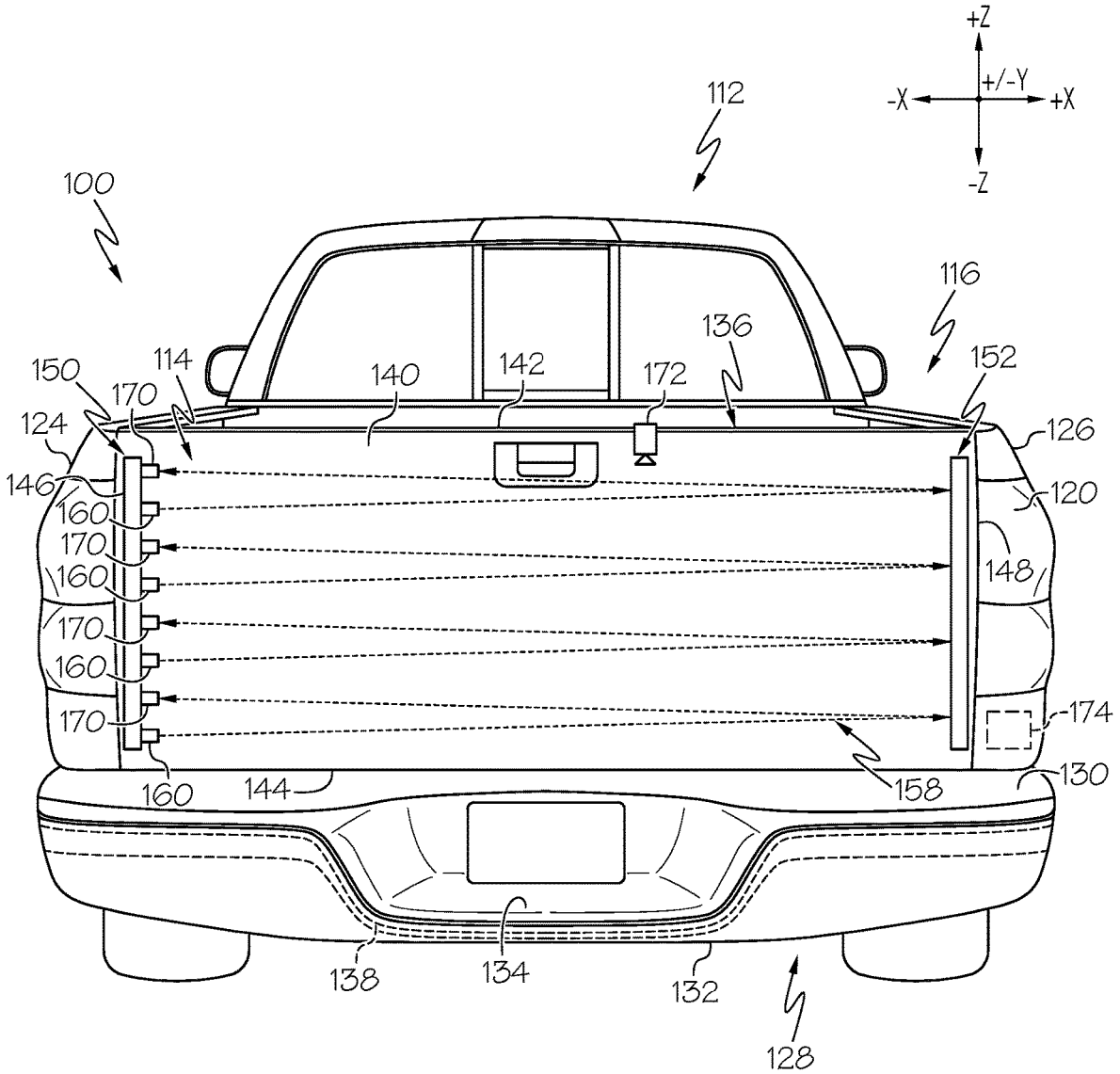
FIG. 4 schematically depicts a rear view of an embodiment of a vehicle including a sensing system provided on an exterior surface of a tailgate according to one or more embodiments shown and described herein.

Referring now to FIG. 4, an embodiment of a power tailgate detection system 100 is shown. The power tailgate detection system 100 includes a vehicle 112 and a sensing system 114. The vehicle 112 includes a vehicle body 116 having rear end 120, a first side wall 124, and an opposite second side wall 126. The vehicle 112 includes a bumper 128 provided at the rear end 120 of the vehicle 112 having an upper surface 130 and an opposite bottom surface 132. A step 134 is formed in the upper surface 130 of the bumper 128 and extends toward the bottom surface 132. The vehicle 112 also includes a tailgate 136 provided at the rear end 120 of the vehicle body 116. The tailgate 136 is pivotally attached to the rear end 120 of the vehicle body 116 and operable between a closed or upright position, as shown in FIG. 4, and an open or horizontal position relative to the bumper 128.

In some embodiments, the bumper 128 includes a load sensor 138 similar to the load sensor 38 discussed herein. The tailgate 136 of the vehicle 112 includes an exterior surface 140 facing a rearward direction away from the vehicle body 116 when the tailgate 136 is in the closed position. The tailgate 136 has an upper edge 142, an opposite lower edge 144, a first side edge 146, and an opposite second side edge 148. The first side edge 146 and the second side edge 148 of the tailgate 136 extend in the vehicle vertical direction between the upper edge 142 and the lower edge 144 of the tailgate 136, which extend in the vehicle lateral direction.

The sensing system 114 is provided on the exterior surface 140 of the tailgate 136 and includes a photoelectric sensor 150 and, in some embodiments, a reflector 152 similar to the photoelectric sensor 50 and the reflector 52 discussed herein. However, the photoelectric sensor 150 is positioned on the exterior surface 140 of the tailgate 136 proximate the first side edge 146 of the tailgate 136, and the reflector 152 is positioned on the exterior surface 140 of the tailgate 136 proximate the opposite second side edge 148 of the tailgate 136 opposite the photoelectric sensor 150. Other than the orientation of the photoelectric sensor 150 and the reflector 152 on the first side edge 146 and the second side edge 148, respectively, as opposed to the upper edge 142 and the lower edge 144, the photoelectric sensor 150 and the reflector 152 may include the same features and be configured to operate in the same manner as the photoelectric sensor 50 and the reflector 52 discussed herein. Thus, in some embodiments, the photoelectric sensor 150 includes a plurality of emitters 160 for emitting radiation 158 and a plurality of receivers 170 for detecting radiation 158 reflected by the reflector 152. Further, the tailgate 136 may include an imaging device 172 and a control unit 174, similar to the imaging device 72 and the control unit 74 discussed herein.

Operation of the power tailgate detection system 10 will now be described with reference to FIGS. 1-3. However, it should be appreciated that the power tailgate detection system 100, as shown in FIG. 4, operates in the same manner. Initially, prior to the control unit 74 receiving the tailgate operating request to move the tailgate 36 from the closed position to the open position, the photoelectric sensor 50 and the reflector 52 may be positioned in a retracted position within the first recess 54 and the second recess 56, respectively, as shown by the dashed lines in FIGS. 2 and 3. Once the control unit 74 receives the tailgate operating request to move the tailgate 36 from the closed position toward the open position, the load sensor 38 is activated to detect a load provided on the upper surface 30 of the bumper 28 and transmit a signal including a detected load to the control unit 74 if a load is detected. If the control unit 74 determines that the detected load exceeds a predetermined threshold, the control unit 74 prohibits the tailgate 36 from moving toward the open position. If the tailgate 36 is prevented from moving toward the open position and carrying out the tailgate operating request, an alert may be provided such as, for example, an audible alert or a displayed message on a display device of the vehicle 12 or a user device, indicating that a load was detected on the bumper 28 and the tailgate 36 will not be opened. The alert may also include an image of the upper surface 30 of the bumper 28 to display what provided the load. If the control unit 74 determines that the detected load does not exceed the predetermined threshold, the photoelectric sensor 50 and the reflector 52 are then moved into the extended position to extend out of the first recess 54 and the second recess 56 of the tailgate 36 in anticipation of the tailgate 36 moving toward the open position.

Once the photoelectric sensor 50 and the reflector 52 are in the extended position, the emitters 60 of the photoelectric sensor 50 emit radiation across the exterior surface 40 of the tailgate 36 and toward the reflector 52, as discussed herein. As noted above, the radiation 58 may form a continuous radiation curtain or a radiation grid 64 comprising a plurality of individual radiation beams 62 emitted from the plurality of emitters 60. In the example situation illustrated in FIG. 2, the tailgate 36 is in an intermediate position, moving from the closed position toward the open position, and an object 76 is positioned within a moving path of the tailgate 36, which interferes with at least a portion of the radiation 58 emitted from the emitters 60, thereby preventing the radiation 58 from reaching the reflector 52. As referred to herein, the moving path of the tailgate 36 is defined by the area or space in which the tailgate 36 moves when moving between the closed position and the open position. As discussed herein, monitoring of an object 76 within the moving path of the tailgate 36 is continuous to determine whether an object suddenly moves into the moving path of the tailgate 36 and to detect if and/or when the object exits the moving path of the tailgate 36.

In embodiments in which the reflector 52 is configured to reflect radiation 58 emitted from the emitters 60, the photoelectric sensor 50 is configured to determine that the object 76 is within the moving path of the tailgate 36 when at least a portion of the radiation 58 emitted from the emitters 60 is not received at the receivers 70. In response to the photoelectric sensor 50 detecting that at least a portion of the radiation 58 is not received at at least one of the receivers 70, the sensing system 14 sends the object present signal to the control unit 74 indicating that the object 76 is present within the moving path of the tailgate 36.

In addition to the object present signal being sent from the sensing system 14 to the control unit 74, the control unit 74 receives object image data from the imaging device 72 when the object 76 is detected in the moving path of the tailgate 36. The control unit 74 processes the object image data including at least one identifying parameter such as, for example, color, shape, size, density, height, and the like, to identify the 76 object within the moving path of the tailgate 36 as a database object stored in the database in the memory of the control unit 74, as discussed above. If the control unit 74 determines that the object 76 captured by the imaging device 72 is, for example, a flower, movement of the tailgate 36 toward the open position may be continued. However, if the control unit 74 determines that the object 76 captured by the imaging device 72 is, for example, rocks, movement of the tailgate 36 toward the open position may be ceased. In some embodiments, when movement of the tailgate 36 is ceased, the tailgate 36 immediately returns toward the closed position. In other embodiments, when movement of the tailgate 36 is ceased, the tailgate 36 remains in position for a predetermined period of time before returning to the closed position. If the photoelectric sensor 50, specifically the receivers 70, detects the full range of radiation 58 during the predetermined period of time, the control unit 74 may determine that the object 76 is moved out of the moving path of the tailgate 36 and the tailgate 36 may continue to move toward the open position.

As shown in FIG. 3, the tailgate 36 is shown in the open position. When the tailgate 36 is in the open position, a gap 78 may be provided between the upper surface 30 of the bumper 28 and the exterior surface 40 of the tailgate 36 when the tailgate 36 is in the open position. In some embodiments, even when an object, such as object 80, is provided on the upper surface 30 of the bumper 28 and interferes with the radiation 58 as the tailgate 36 moves toward the open position, continued movement of the tailgate 36 may be permitted after the tailgate 36 reaches a predetermined degree of rotation. For example, the object 80 on the upper surface 30 of the bumper 28 may have a height less than a height of the gap 78 and, thus, the object 80 will not contact the exterior surface 40 of the tailgate 36 when the tailgate 36 is in the open position. Thus, when the photoelectric sensor 50 determines that the object 80 interferes with the radiation 58 after the tailgate 36 has rotated a predetermined degree of rotation such as, for example, 70 degrees, 75 degrees, 80 degrees, or the like, any interference by the object 80 with the radiation 58 will be disregarded. This is also applicable in embodiments in which the tailgate 36 may be pivotally attached to the vehicle 12 such that the bumper 28 itself interferes with the radiation 58 when the tailgate 36 moves toward the open position. To avoid the bumper 28 causing the tailgate 36 to cease movement toward the open position when it interferes with the radiation 58, interference with the radiation 58 may be disregarded after the tailgate 36 reaches a predetermined degree of rotation as the bumper 28 will not actually contact the exterior surface 40 of the tailgate 36 when the tailgate 36 is in the open position.

From the above, it is to be appreciated that defined herein is a power tailgate detection device including an emitter and a receiver for detecting an object within a moving path of the tailgate of a vehicle to prevent the tailgate from contacting the object as the tailgate operates from a closed position toward an open position. The emitter emits radiation across an exterior surface of the tailgate, which is directed toward the receiver. The receiver that detects the radiation emitted by the emitter. If the radiation emitted by the emitter is not received by the receiver, the power tailgate detection device determines that an object is within the moving path of the tailgate and prohibits movement of the tailgate toward the open position until it is determined that the object is no longer within the moving path of the tailgate.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A power tailgate detection system comprising:

a vehicle including a bumper and a tailgate moveable between a closed position and an open position relative to the bumper, the tailgate having an exterior surface;

a sensing system disposed on the exterior surface of the tailgate, the sensing system comprising:

at least one emitter positioned to emit radiation in a direction parallel to the exterior surface of the tailgate, and at least one receiver positioned to receive the radiation emitted by the at least one emitter;

a reflector positioned to reflect the radiation from the at least one emitter toward the at least one receiver; and a control unit configured to control operation of the tailgate between the closed position and the open position and prohibit movement of the tailgate toward the open position when an object interferes with the radiation and the control unit determines that the tailgate will contact the object upon continued movement of the tailgate toward the open position.

2. The power tailgate detection system of claim 1, wherein the tailgate has an upper edge, an opposite lower edge, a first side edge, and an opposite second side edge, the first side edge and the second side edge of the tailgate extend in a vehicle vertical direction between the upper edge and the lower edge of the tailgate extending in a vehicle lateral direction, the at least one emitter and the at least one receiver are provided proximate one of the upper edge and the lower edge of the tailgate.

3. The power tailgate detection system of claim 1, wherein the tailgate has an upper edge, an opposite lower edge, a first side edge, and an opposite second side edge, the first side edge and the second side edge of the tailgate extend in a vehicle vertical direction between the upper edge and the lower edge of the tailgate extending in a vehicle lateral direction, the at least one emitter and the at least one receiver is provided proximate one of the first side edge and the second side edge of the tailgate.

4. The power tailgate detection system of claim 1, wherein the bumper includes a load sensor for detecting a load on an upper surface of the bumper, the bumper is communicatively coupled to the control unit to transmit a signal corresponding to the detected load.

5. The power tailgate detection system of claim 4, wherein the control unit prevents operation of the tailgate from the closed position toward the open position when the detected load exceeds a predetermined threshold.

6. The power tailgate detection system of claim 1, further comprising a camera for identifying an object interfering with the radiation, wherein the control unit controls operation of the tailgate from the closed position toward the open position based on an identification of the object interfering with the radiation.

7. The power tailgate detection system of claim 1, wherein the tailgate includes at least one recess formed in the exterior surface of the tailgate, the at least one emitter and the at least one receiver are each movable within the at least one recess between a retracted position in which the at least one emitter and the at least receiver are positioned within the at least one recess of the tailgate, and an extended position in which the at least one emitter and the at least one receiver are extended from the at least one recess of the tailgate.

8. The power tailgate detection system of claim 1, wherein the reflector has an elongated shape and extends along the tailgate in a vehicle lateral direction.

9. The power tailgate detection system of claim 1, wherein the sensing system comprises:

a plurality of emitters configured to emit radiation toward the reflector, the plurality of emitters are spaced apart from one another in a vehicle lateral direction; and a plurality of receivers configured to receive and detect radiation reflected by the reflector, the plurality of receivers are spaced apart from one another in the vehicle lateral direction.

10. The power tailgate detection system of claim 9, wherein each of the plurality of emitters emits a radiation beam parallel to the exterior surface of the tailgate, the plurality of emitters providing a radiation grid of radiation beams extended from the plurality of emitters toward the reflector.

11. The power tailgate detection system of claim 9, wherein the plurality of emitters and the plurality of receivers are arranged in an alternating pattern in the vehicle lateral direction.

12. A power tailgate detection system comprising:

a vehicle including a bumper and a tailgate moveable between a closed position and an open position relative to the bumper, the tailgate having an exterior surface, the bumper including a load sensor for detecting a load on an upper surface of the bumper, the load sensor communicatively coupled to the control unit to transmit a signal corresponding to the detected load;

a sensing system disposed on the exterior surface of the tailgate, the sensing system comprising:

at least one emitter positioned to emit radiation in a direction parallel to the exterior surface of the tailgate, and at least one receiver positioned to receive the radiation emitted by the at least one emitter; and a control unit configured to control operation of the tailgate between the closed position and the open position and prohibit movement of the tailgate toward the open position when an object interferes with the radiation and the control unit determines that the tailgate will contact the object upon continued movement of the tailgate toward the open position.

13. The power tailgate detection system of claim 12, wherein the tailgate has an upper edge, an opposite lower edge, a first side edge, and an opposite second side edge, the first side edge and the second side edge of the tailgate extend in a vehicle vertical direction between the upper edge and the lower edge of the tailgate extending in a vehicle lateral direction, the at least one emitter and the at least one receiver are provided proximate one of the upper edge and the lower edge of the tailgate.

14. The power tailgate detection system of claim 12, wherein the tailgate has an upper edge, an opposite lower edge, a first side edge, and an opposite second side edge, the first side edge and the second side edge of the tailgate extend in a vehicle vertical direction between the upper edge and the lower edge of the tailgate extending in a vehicle lateral direction, the at least one emitter and the at least one receiver is provided proximate one of the first side edge and the second side edge of the tailgate.

15. The power tailgate detection system of claim 12, wherein the control unit prevents operation of the tailgate from the closed position toward the open position when the detected load exceeds a predetermined threshold.

16. The power tailgate detection system of claim 12, further comprising a camera for identifying an object interfering with the radiation, wherein the control unit controls operation of the tailgate from the closed position toward the open position based on an identification of the object interfering with the radiation.

17. The power tailgate detection system of claim 12, wherein the tailgate includes at least one recess formed in the exterior surface of the tailgate, the at least one emitter and the at least one receiver are each movable within the at least one recess between a retracted position in which the at least one emitter and the at least receiver are positioned within the at least one recess of the tailgate, and an extended position in which the at least one emitter and the at least one receiver are extended from the at least one recess of the tailgate.

* * * * *